US008072325B2

(12) United States Patent
Oyamada

(10) Patent No.: US 8,072,325 B2
(45) Date of Patent: Dec. 6, 2011

(54) TRESPASS DETECTION SYSTEM

(75) Inventor: Hideo Oyamada, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 718 days.

(21) Appl. No.: 11/907,050

(22) Filed: Oct. 9, 2007

(65) Prior Publication Data

US 2008/0266088 A1 Oct. 30, 2008

(30) Foreign Application Priority Data

Apr. 27, 2007 (JP) ..... 2007-118791

(51) Int. Cl.
*G08B 13/26* (2006.01)

(52) U.S. Cl. ..... 340/561; 340/552; 340/565

(58) Field of Classification Search ..... None
See application file for complete search history.

(56) References Cited

U.S. PATENT DOCUMENTS

| | | | | | |
|---|---|---|---|---|---|
| 4,091,367 | A | * | 5/1978 | Harman | 340/552 |
| 4,546,344 | A | * | 10/1985 | Guscott et al. | 340/501 |
| 4,721,945 | A | * | 1/1988 | Maki et al. | 340/515 |
| 5,914,655 | A | * | 6/1999 | Clifton et al. | 340/506 |
| 6,054,927 | A | * | 4/2000 | Brickell | 340/573.1 |
| 6,288,640 | B1 | * | 9/2001 | Gagnon | 340/539.17 |
| 6,907,388 | B2 | * | 6/2005 | Suzuki et al. | 702/188 |
| 7,154,391 | B2 | * | 12/2006 | Maki et al. | 340/550 |

FOREIGN PATENT DOCUMENTS

| | | | | |
|---|---|---|---|---|
| JP | 9-172630 | A | | 6/1997 |
| JP | 11-198764 | A | | 7/1999 |
| JP | 2003-002197 | | | 1/2003 |
| JP | 2004-101239 | | * | 4/2004 |
| JP | 2004-306909 | | * | 11/2004 |
| JP | 2004-309423 | A | | 11/2004 |
| JP | 2005-327038 | A | | 11/2005 |

* cited by examiner

*Primary Examiner* — Daniel Wu
*Assistant Examiner* — Brian Wilson
(74) *Attorney, Agent, or Firm* — Buchanan Ingersoll & Rooney PC

(57) ABSTRACT

A trespass detection system includes an electronic-wave trespass detection sensor which is provided near the boundary of a trespass surveillance area, and a detection device body which detects trespassing into the area on the basis of a detection output from the sensor. The detection device body includes a change quantity storing unit which stores the quantity of change in electric field intensity over a predetermined period for each detection zone that is set in advance along the direction of extension of the electronic-wave trespass detection sensor, a statistical processing unit which statistically processes each of the quantities of change, a threshold value setting unit which corrects a threshold value on the basis of the result of the processing and sets a new threshold value, and a trespass detection determining unit which compares the quantity of change and the threshold value and thus determines that there is trespassing by an object.

3 Claims, 14 Drawing Sheets

FIG. 6

| ZONE | X1 | Y1 | X2 | Y2 | X3 | Xn |
|---|---|---|---|---|---|---|
| DETECTION/ NON-DETECTION | DETECTION | NON-DETECTION | DETECTION | NON-DETECTION | DETECTION | DETECTION |

FIG. 8

| TIME / DETECTION ZONE | t1 | t2 | t3 | — — | — — | tk | MOVING AVERAGE OF QUANTITY OF CHANGE |
|---|---|---|---|---|---|---|---|
| X1 | Δ11 | Δ12 | Δ13 | — — | — — | Δ1k | Δ1 |
| X2 | Δ21 | Δ22 | Δ23 | — — | — — | Δ2k | Δ2 |
| — — — | — — — | — — — | — — — | — — — | — — — | — — — | — — — |
| Xn | Δn1 | Δn2 | Δn3 | — — | — — | Δnk | Δn |

FIG. 11

| WEATHER CONDITION \ DETECTION ZONE | X1 | X2 | --- | -- | Xn |
|---|---|---|---|---|---|
| 1 | Δ sh11 | Δ sh21 | | | Δ shn1 |
| 2 | Δ sh12 | Δ sh22 | | | Δ shn2 |
| 3 | Δ sh13 | Δ sh23 | | | Δ shn3 |
| | | | | | |

TRESPASS DETECTION SYSTEM

BACKGROUND OF THE INVENTION

1. Field of the Invention

The present invention relates to a trespass detection system that detects whether there is trespassing by a suspicious person or the like in a broad range of area such as a plant, substation or airport, and the position of the trespassing.

2. Description of the Related Art

Traditionally, as a trespass detection system for detecting whether there is trespassing by a suspicious person or the like and the position of the trespassing, plural surveillance camera are installed to detect whether there is trespassing (see, for example, JP-A-9-172630).

However, in the case where such surveillance cameras are used, the detection range and the timing of detection must be set by the position of the surveillance cameras, the position of images, or switching of the surveillance cameras. The accuracy of setting the detection range is poor and the way of setting is complicated. Moreover, as the surveillance range becomes broader, the number of surveillance cameras to be installed must be increased, which raises the cost. Therefore, the system is not suitable for detecting whether there is trespassing in a broad range of area such as a plant, substation or airport.

Thus, in order to enable detection of whether there is trespassing in a broad range of surveillance area such as a plant, substation or airport and the position of the trespassing, the present applicants have provided a trespass detection system in which a leakage transmission line on the transmitting side and a leakage transmission line on the receiving side are arranged parallel to each other at a predetermined spacing from each other so that a leakage electronic wave can be sent and received between the two sides. It is determined that there is trespassing when the electronic wave received on the leakage transmission line on the receiving side is changed, and the position of the trespassing can be specified (see, for example, JP-A-2004-309423).

In the trespass detection system described in JP-A-2004-309423, a threshold value must be set in advance for determination in trespass detection. For this setting of this threshold value, tests are repeated and the signal intensity and the quantity of change are measured when the system is installed, and a proper value is decided on the basis of the results of the measurement.

However, in the case where tests are repeated when the trespass detection system installed, and a threshold value is decided on the basis of the result of the measurement, as in the traditional technique, the measuring work is highly labor- and time-consuming.

Also, the electric wave environment may be changed by the influence of disturbance such as changes in weather conditions and the existence of a strong-field object. Therefore, the threshold that has once been set may not be proper for detecting trespassing. Thus, traditionally, it is necessary to conduct a work of manually updating to a proper threshold value each time in accordance with a change due to disturbance, and also in this respect, the work of changing the threshold value requires extra labor and time.

SUMMARY OF THE INVENTION

It is an object of the present invention to provide a trespass detection system in which a threshold value for determination in trespass detection can be automatically set so that the labor for the threshold value setting work at the time of installing the system can be reduced, and which can make dynamic adjustment by enabling constant setting of a proper threshold value in accordance with a change in the electronic wave environment due to disturbance at the time of operating the system.

According to a first aspect of the invention, a trespass detection system includes: an electronic-wave trespass detection sensor which is provided near a boundary of a trespass surveillance area and which has a transmitting-side leakage transmission line and a receiving-side leakage transmission line arranged parallel to each other at a predetermined space from each other; and a detection device body including a change quantity storing unit which stores a quantity of change in electric field intensity when an electronic wave leaked from the transmitting-side leakage transmission line is received on the receiving-side leakage transmission line over a predetermined period for each detection zone that is set in advance along the direction of extension of the electronic-wave trespass detection sensor, a statistical processing unit which statistically processes each quantity of change stored in the change quantity storing unit, a threshold value setting unit which corrects a threshold value that is set in advance on the basis of the result of processing by the statistical processing unit and sets a new threshold value, and a trespass detection determining unit which determines that there is trespassing by an object into a trespass surveillance area in the case where the quantity of change in electric field intensity is larger than the threshold value set by the threshold value setting unit.

According to a second aspect of the invention, a trespass detection system includes: an electronic-wave trespass detection sensor which is provided near a boundary of a trespass surveillance area and which has a transmitting-side leakage transmission line and a receiving-side leakage transmission line arranged parallel to each other at a predetermined space from each other; and a detection device body including a weather measuring device which measures weather conditions such as temperature, humidity, barometric pressure, precipitation and wind speed, a threshold value registration unit in which a threshold value corresponding to each weather condition is registered in advance in association with each detection zone that is set in advance along the direction of extension of the electronic-wave trespass detection sensor, a threshold value setting unit which searches the threshold value registration unit for a threshold value corresponding to a weather condition measured by the weather measuring device and sets the threshold value as a current threshold value, and a trespass detection determining unit which determines that there is trespassing by an object into a trespass surveillance area in the case where a quantity of change in electric field intensity when an electronic wave leaked from the transmitting-side leakage transmission line is received on the receiving-side leakage transmission line is larger than the threshold value set by the threshold value setting unit.

According to the first or second aspect of the invention, a threshold value for determination in trespass detection can be automatically set. Therefore, the labor for threshold value setting work at the time of installing the system can be reduced. Also, since a proper threshold value can be constantly set in real time in accordance with changes in the electronic wave environment due to the influence of disturbance at the time of operating the system, a trespass detection system that can make dynamic adjustment can be provided.

The foregoing and other objects, features, aspects and advantages of the present invention will become more apparent from the following detailed description when read in conjunction with the accompanying drawings.

BRIEF DESCRIPTION OF THE DRAWINGS

FIG. 6 is an explanatory view of a registration table showing detection zones and non-detection zones that are set by a detection zone setting unit in the system.

FIG. 8 is an explanatory view showing specific quantities of change in electric field intensity stored in a change quantity storing unit in the system.

FIG. 11 is an explanatory view showing specific threshold values registered in a threshold value registration unit in the system.

DETAILED DESCRIPTION OF THE PREFERRED EMBODIMENTS OF THE INVENTION

First Embodiment

Figure 1:
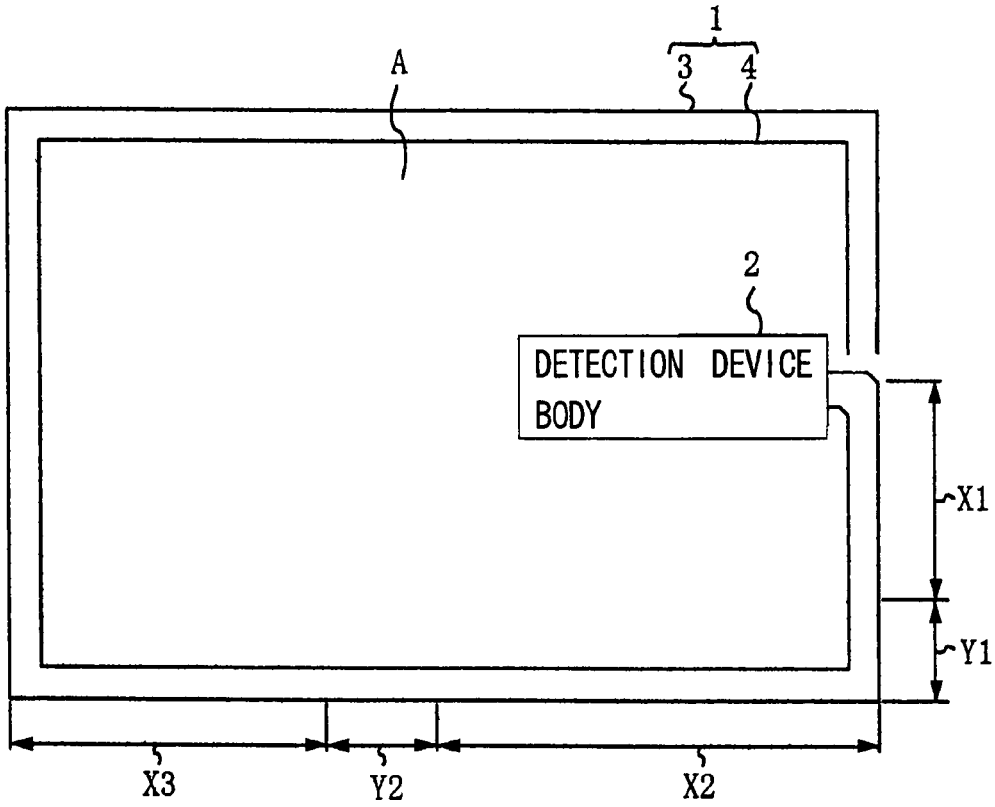
FIG. 1 is a configuration view of a trespass detection system according to the first embodiment of the invention.
Figure 2:
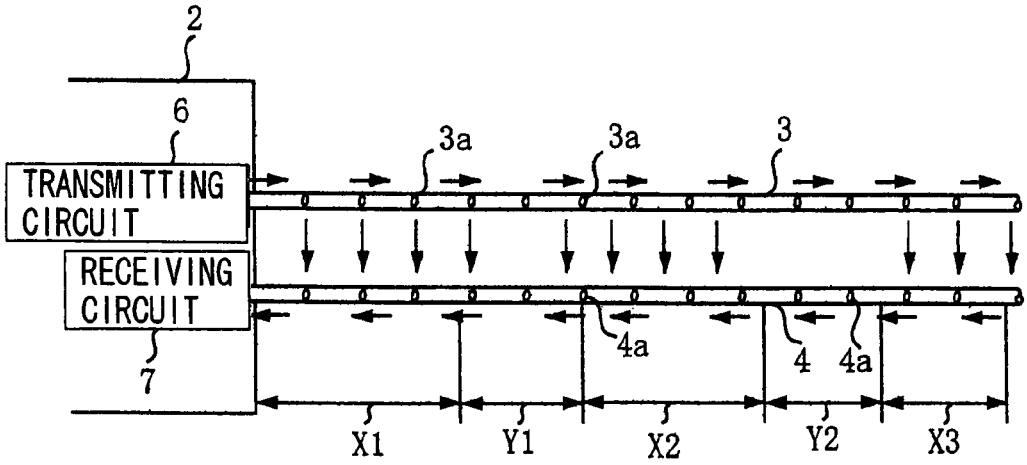
FIG. 2 is a configuration view showing a state where an electronic-wave trespass detection sensor employed in the system is connected to a detection device body.

FIG. 1 is a configuration view showing the overall configuration of a trespass detection system according to the first embodiment of the invention. FIG. 2 is a configuration view showing a state where an electronic-wave trespass detection sensor used in the system is connected to a detection device body.

The trespass detection system according to the first embodiment has an electronic-wave trespass detection sensor 1 which is provided near the boundary of a trespass surveillance area A, and a detection device body 2 which detects trespassing by a suspicious person or the like into the trespass surveillance area A on the basis of a detection output of the electronic-wave trespass detection sensor 1.

The electronic-wave trespass detection sensor 1 has a transmitting-side leakage transmission line 3 and a receiving-side leakage transmission line 4 that are provided parallel to each other at a predetermined spacing (for example, a few meters) from each other. For the leakage transmission lines 3 and 4, for example, commercially available leakage coaxial cables are used and leakage points are formed by slots 3*a* and 4*a* which are provided by removing the outer covering at a predetermined pitch (for example, at intervals of a few meters) along the direction of extension of the leakage coaxial cables.

When a signal sent from a transmitting circuit 6, which will be described later, of the detection device body 2 to the transmitting-side leakage transmission line 3 is leaked from the slot 3*a*, its electronic wave is received through the slot 4*a* of the receiving-side leakage transmission line 4 and received by a receiving circuit 7, which will be described later.

Now, the principle of detecting whether there is trespassing by an object and the position of the trespassing, with this trespass detection system, will be described.

Figure 3:
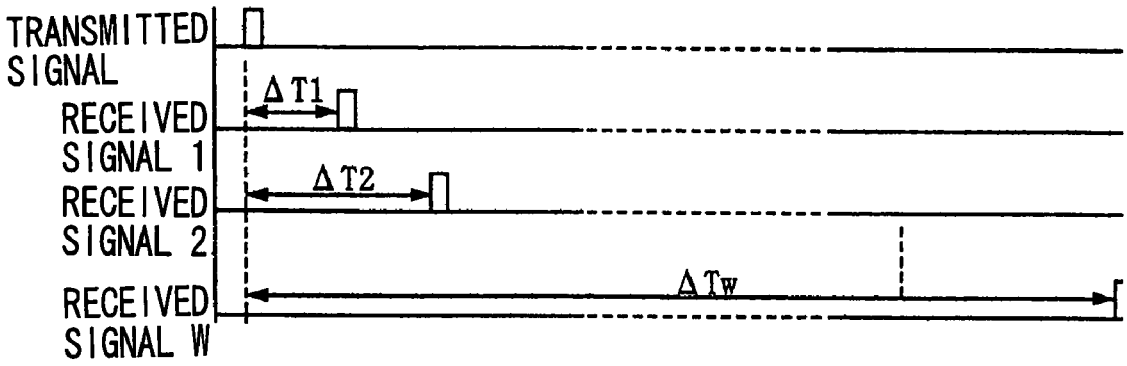
FIG. 3 is a timing chart showing the relation between a transmitted signal and a received signal of the electronic-wave trespass detection sensor in the system.

As shown in FIG. 3, in the case where a pulse-like transmitted signal is outputted from the transmitting circuit 6, the leakage electronic wave from the first slot of the transmitting-side leakage transmission line 3 is received via the first slot of the receiving-side leakage transmission line 4 and reaches the receiving circuit 7. The arrival time of its received signal 1 is $\Delta T1$ after the time of transmission. Similarly, in the case where a transmitted signal is outputted from the transmitting circuit 6, the leakage electronic wave from the second slot of the transmitting-side leakage transmission line 3 is received via the second slot of the receiving-side leakage transmission line 4 and reaches the receiving circuit 7. The arrival time of its received signal 2 is $\Delta T2$ after the time of transmission. In this manner, these arrival times $\Delta T1$, $\Delta T2$ . . . are dependent on the length of the signal transmission line from the transmitting side to the receiving side. Therefore, if the length of the signal transmission line is known, these arrival times can be easily found by calculation since the propagation speed of the signal is 300,000 km/second (if it is through the air).

Therefore, if the data of the arrival times $\Delta T1$, $\Delta T2$ . . . calculated in advance on the basis of the system configuration is saved in the receiving circuit 7, an actually received signal can be collated with the saved data to determine which slot the received signal has come through. Moreover, in the case where a suspicious person or the like has trespassed on an area where a leakage electronic wave exists, the receiving state of the leakage electronic wave is changed by the trespassing. Therefore, by measuring, in the detection device body 2, the quantity of change in the field intensity when the electronic wave transmitted from the transmitting-side leakage transmission line 3 is received on the receiving-side leakage transmission line 4, it is possible to detect which position the suspicious person or the like has trespassed at, along the transmitting-side and receiving-side leakage transmission lines 3 and 4.

Figure 4:
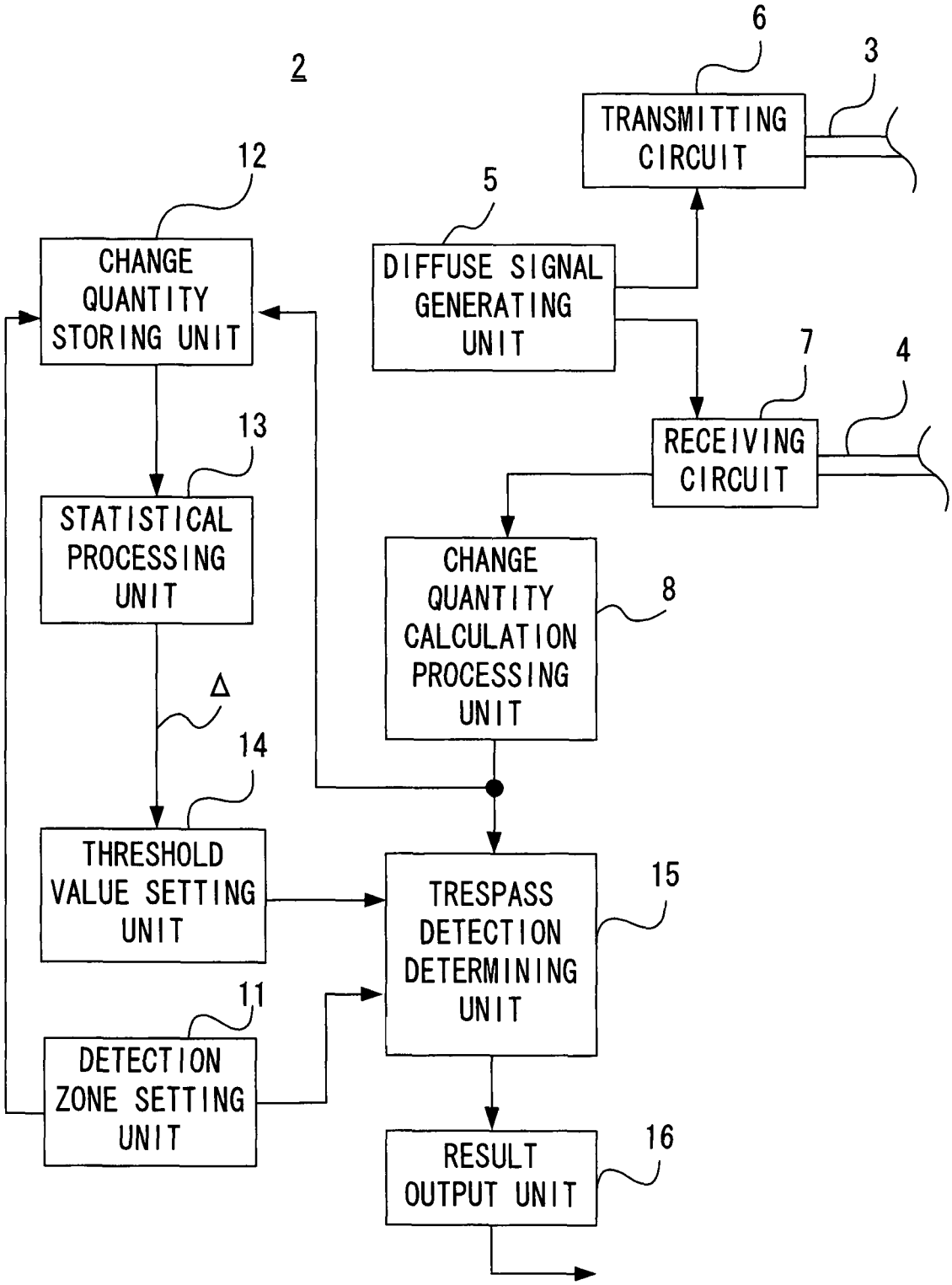
FIG. 4 is a block diagram showing the configuration of the detection device body in the system.

Next, the detection device body 2 will be described. FIG. 4 is a block diagram showing the configuration of the detection device body 2 in the trespass detection system according to the first embodiment.

Figure 5:
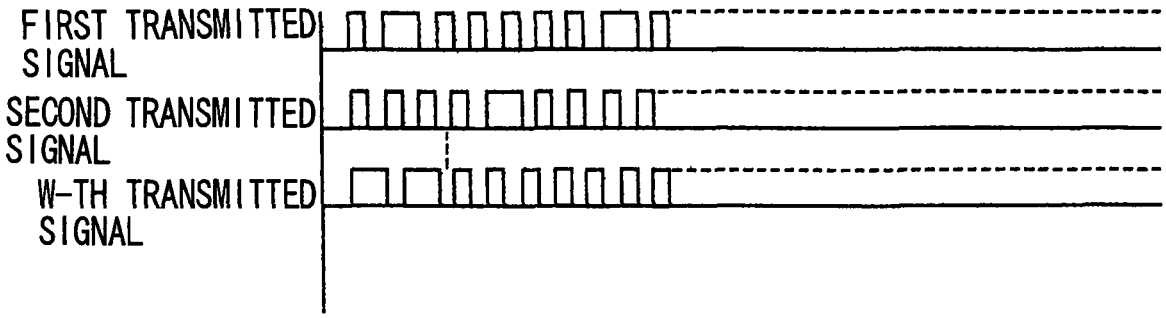
FIG. 5 is a timing chart showing a specific example of the transmitted signal of the electronic-wave trespass detection sensor in the system.

Here, a spread spectrum system is employed in order to increase the trespass detection accuracy. A diffuse signal generating unit 5 outputs a PN code signal as a pseudo-noise signal, and it outputs this PN code signal to each of the transmitting circuit 6 and the receiving circuit 7. The transmitting circuit 6 performs diffuse modulation of a high-frequency carrier wave by the PN code signal from the diffuse signal generating unit 5, as shown in FIG. 5, and outputs the diffuse-modulated signal to the transmitting-side leakage transmission line 3. The receiving circuit 7 demodulates a signal inputted from the receiving-side leakage transmission line 4 by the PN code signal from the diffuse signal generating unit 5 and outputs the demodulated signal.

A change quantity calculation processing unit 8 is to calculate the quantity of change Δ in the field intensity when an electronic wave transmitted from each slot 3*a* of the transmitting-side leakage transmission line 3 is received through each slot 4*a* of the receiving-side leakage transmission line 4, on the basis of the signal outputted from the receiving circuit 7.

A detection zone setting unit 11 is to set, in advance, detection zones X1, X2, . . . and non-detection zones Y1, Y2, . . . along the direction of extension of the electronic-wave trespass detection sensor 1, as shown in FIG. 6. For example, the detection zone setting unit 11 includes a table memory in which data prescribing detection zones and non-detection zones has been registered in advance, as shown in FIG. 6.

The reason for setting the detection zones X1, X2, . . . and the non-detection zones Y1, Y2, . . . for the electronic-wave trespass detection sensor 1 in this manner by the detection zone setting unit 11 is as follows. In the case where the trespass surveillance area A is broad and the electronic-wave trespass detection sensor 1 is provided over a long distance, there may be, for example, a side gate and a public road in some zones over this distance, and such zones must be designated as the non-detection zones Y1, Y2 . . . where trespassing should not be detected.

Figure 7:
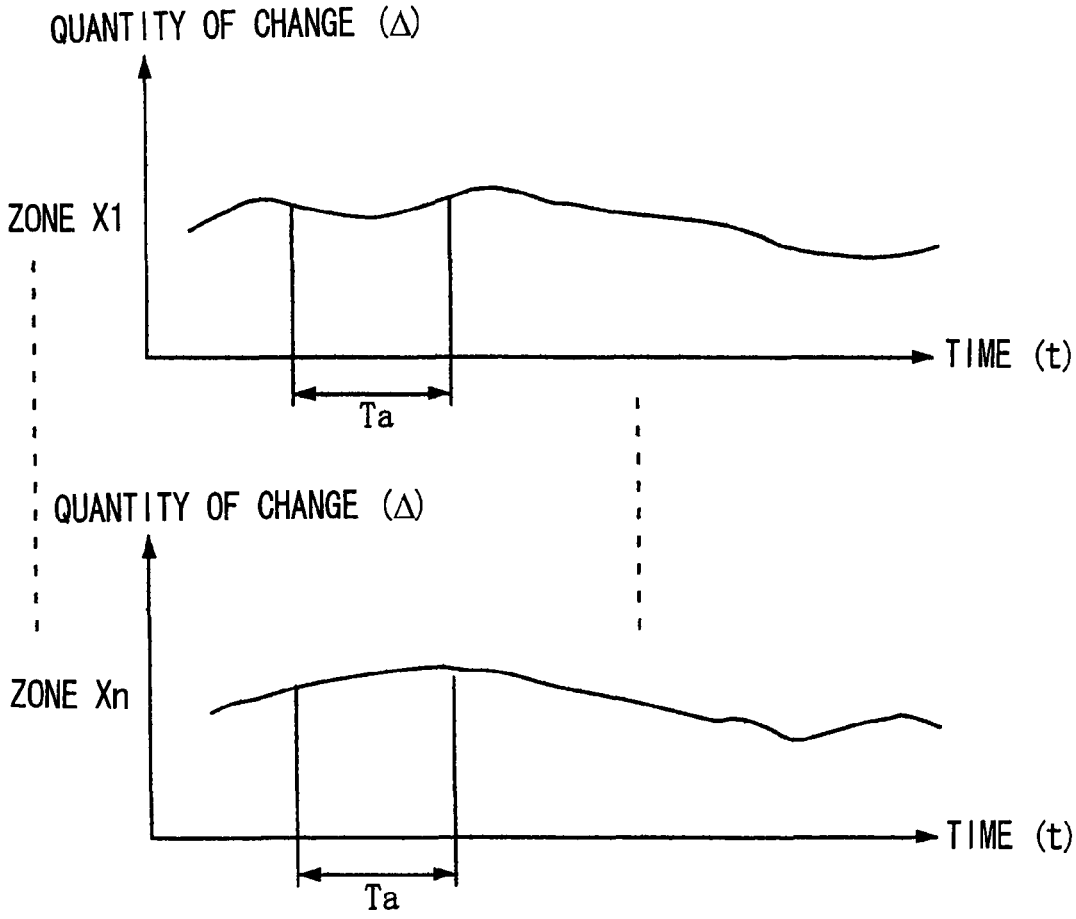
FIG. 7 is a view showing an example of change in electric field intensity with the lapse of time for each detection zone.

A change quantity storing unit 12 is to sequentially store the quantity of change in field intensity acquired at the change quantity calculation processing unit 8 for each of the detection zones X1, X2, . . . Xn set by the detection zone setting unit 11, over a predetermined period Ta (for example, five minutes), as shown in FIG. 7.

A statistical processing unit 13 is to statistically process the quantity of change in field intensity for each of the detection zones X1, X2, . . . Xn stored in the change quantity storing unit 12. Here, a moving average of the quantity of change within the predetermined period Ta is calculated for the respective detection zones X1, X2, . . . Xn stored in the change quantity storing unit 12. It is also possible to calculate a standard deviation or the like from the distribution of the quantity of change in field intensity within the predetermined period Ta, instead of finding the moving average.

A threshold value setting unit 14 is to calculate a correction value for each of the detection zones X1, X2, . . . Xn on the basis of the result of processing by the statistical processing unit 13, then correct the previous threshold value with the correction value, and set a new threshold value. The reason for having to set a threshold value individually for each of the detection zones X1, X2, . . . Xn is that, in the case where the trespass detection area A is broad, the degree of influence of disturbance differs among the detection zones X1, X2, . . . Xn.

A trespass detection determining unit 15 is to compare the quantity of change acquired at the change quantity calculation processing unit 8 and the threshold value set by the threshold value setting unit 14, for each of the detection zones X1, X2, . . . Xn set by the detection zone setting unit 11, and when the quantity of change in field intensity is larger than the preset threshold value, to determine that there is trespassing and to specify the detection zone where the trespassing has occurred.

A result output unit 16 is to display, for example, on a monitor, the result of whether there is trespassing and the result of specifying the detection zone in the case where there is trespassing by the trespass detection determining unit 15, or to output an alarm.

Next, the operation of the trespass detection system having the above configuration, particularly, the way of setting a threshold value for trespass determination, will be described.

A transmitted signal from the transmitting circuit 6 of the detection device body 2 is diffuse-modulated by a PN code signal from the diffuse signal generating unit 5 and is outputted to the transmitting-side leakage transmission line 3. The receiving circuit 7 demodulates the signal inputted from the receiving-side leakage transmission line 4 by the PN code signal from the diffuse signal generating unit 5 and outputs the demodulated signal. The change quantity calculation processing unit 8 calculates the quantity of change in field intensity when the electronic wave transmitted from each slot 3*a* of the transmitting-side leakage transmission line 3 is received through each slot 4*a* of the receiving-side leakage transmission line 4, on the basis of the signal outputted from the receiving circuit 7.

The change quantity storing unit 12 sequentially stores the quantity of change in field intensity acquired at the change quantity calculation processing unit 8 for each of the detection zones X1, X2, . . . Xn set by the detection zone setting unit 11, over the predetermined period Ta (for example, five minutes), as shown in FIG. 7. Therefore, in the change quantity storing unit 12, data of the quantity of change acquired at each sampling time t1, t2, . . . ti in the predetermined period Ta, for each of the detection zones X1, X2, . . . Xn is stored, as shown in FIG. 8.

Next, the statistical processing unit 13 calculates moving average values Δ1, Δ2, . . . Δn of the quantities of change in the predetermined period Ta with respect to the respective detection zones X1, X2, Xn stored in the change quantity storing unit 12. For example, in the case where data of k quantities of change, Δ11, Δ12, . . . Δ1*k* is acquired in the predetermined period Ta for a certain detection zone X1, (Δ11+Δ12+ . . . +Δ1*k*)/k is calculated as the moving average value Δ1.

Then, the threshold value setting unit 14 calculates a correction value for correcting the threshold value on the basis of the result of processing by the statistical processing unit 13, then corrects the previous threshold value with the correction value, and sets a new threshold value. For example, if the moving average of the quantities of change in a certain detection zone Xi is Δi and the previous threshold value for the detection zone Xi is Δshi, Δi×50% is used as a correction value for correcting the threshold value and Δshi+Δi×50% is set as a new threshold value.

The trespass detection determining unit 15 compares the quantity of change acquired at the change quantity calculation processing unit 8 and the threshold value set by the threshold value setting unit 14, for each of the detection zones X1, X2, . . . Xn set by the detection zone setting unit 11. When the quantity of change in field intensity is larger than the preset threshold value, the trespass detection determining unit 15 determines that there is trespassing by an object such as a suspicious person, and detects the detection zone where the trespassing has occurred. Then, the result output unit 16 display, for example, on a monitor, the result of the trespass detection by the trespass detection determining unit 15, or outputs an alarm.

In this manner, in the first embodiment, the quantity of change in field intensity is sequentially stored over the predetermined period Ta for each of the detection zones X1, X2, . . . Xn and is statistically processed, and a threshold value is set on the basis of the statistically processed value. Therefore, when the system is operated, if the electronic wave environment is changed by the influence of disturbance such as a change in weather conditions or the existence of a strong field object, a proper threshold value can constantly be set in real time in accordance with the change. That is, when the electronic wave environment between the transmitting-side and receiving-side leakage transmission lines 3 and 4 of the trespass detection sensor 1 is changed by the influence of disturbance, the moving average values Δ1, Δ2, . . . Δn of the quantities of change in field intensity increase accordingly and this is directly reflected onto the threshold value. Therefore, dynamic adjustment can be made with respect to trespass detection and labor in the threshold value setting work at the time of installing the system can be reduced.

Second Embodiment

Figure 9:
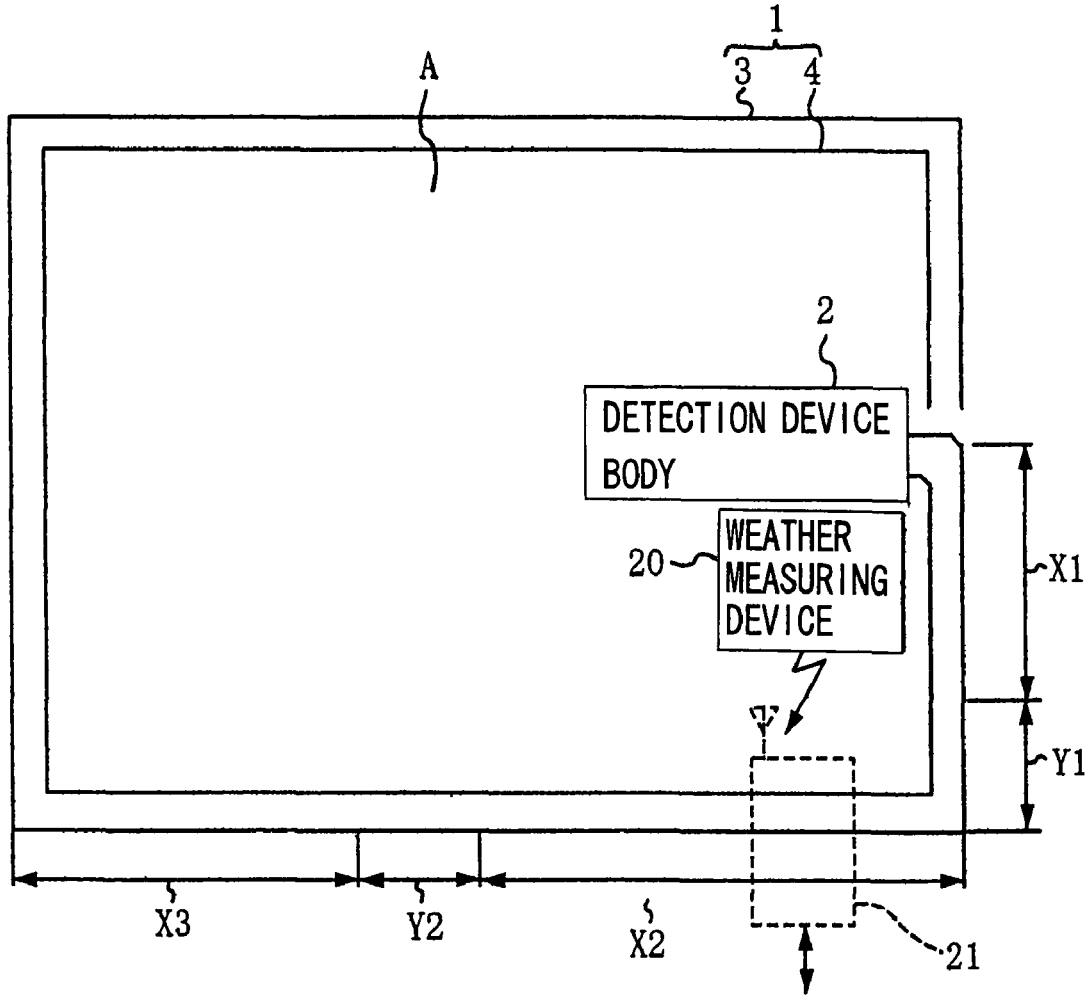
FIG. 9 is a configuration view of a trespass detection system according to the second embodiment of the invention.

In a trespass detection system according to the second embodiment, a weather measuring device 20 and a trespass simulation device 21 are provided, as shown in FIG. 9, in addition to the configuration of the first embodiment (that is, the electronic-wave trespass detection sensor 1 and the detection device body 2).

The weather measuring device 20 is to measure weather conditions such as temperature, humidity, barometric pressure, precipitation and snowfall, wind speed, wind direction, and the amount of solar radiation. Also, the trespass simulation device 21 is constituted with a robot simulating objects such as a person, and in the case where a change in the weather conditions is measured by the weather measuring device 20, this triggers the trespass simulation device 21 to start and trespass onto the detection zone of the electronic-wave trespass detection sensor 1.

The other parts of the configuration are similar to the first embodiment.

Since the electronic-wave environment between the transmitting-side and receiving-side leakage transmission lines 3 and 4 of the trespass detection sensor 1 is changed by a change in the weather conditions, when it has occurred, this triggers the trespass simulation device 21 to start and trespass onto the detection zone of the electronic-wave trespass detection sensor 1, and the quantity of change Δ between the field intensity at the time when the trespass simulation device 21 is caused to trespass previously and the field intensity at the time when the trespass simulation device 21 is caused to trespass this time is calculated by the change quantity calculation processing unit 8 and stored into the change quantity storing unit 12.

Then, the threshold value setting unit 14, for example, calculates a correction value for correcting the threshold value on the basis of the quantity of change Δ stored in the change quantity storing unit 12 and evenly increases all the threshold values set for all the detection zones X1, X2, . . . Xn by using this correction value.

For example, if the quantity of change between the field intensity at the time when the trespass simulation device 21 is caused to trespass previously and the field intensity at the time when the trespass simulation device 21 is caused to trespass this time is Δ and the previous threshold value of a certain detection zone Xi is Δshi, Δ×50% is set as a correction value (bias value) for correcting the threshold value and Δshi+Δ×50% is set as a new threshold value.

Thus, also in the second embodiment, when the electronic wave environment is changed by a change in weather conditions, all the threshold values set for the detection zones X1, X2, . . . Xn are corrected accordingly with a correction value. Therefore, it is possible to set a proper threshold value in real time in accordance with a change in the electronic wave environment due to a change in weather conditions.

Third Embodiment

Figure 10:
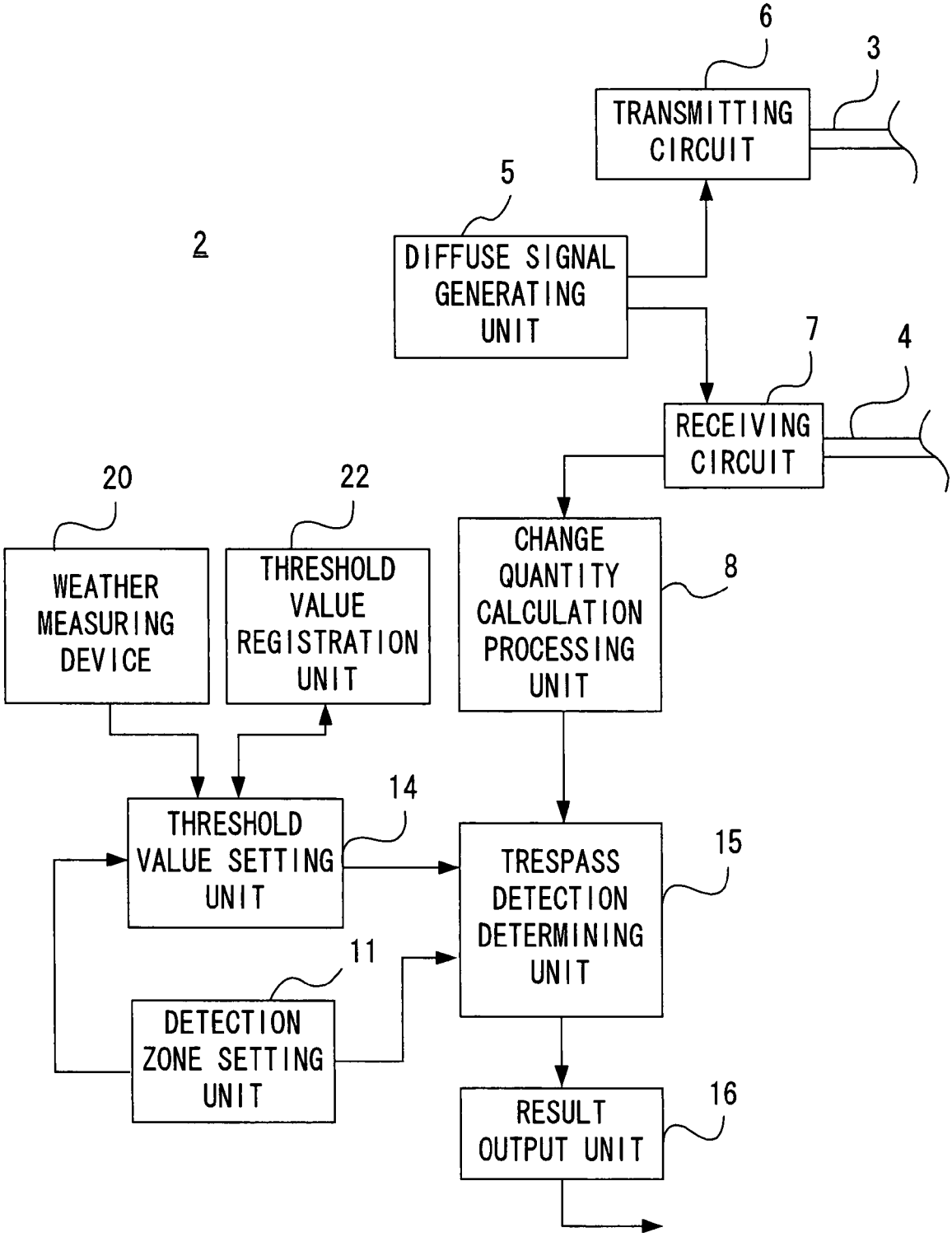
FIG. 10 is a block diagram showing the configuration of a detection device body in a trespass detection system according to the third embodiment of the invention.

FIG. 10 is a block diagram showing the configuration of a detection device body 2 in a trespass detection system according to the third embodiment. The components corresponding to the configuration of the first embodiment shown in FIG. 4 are denoted by the same numerals.

In the trespass detection system according to the third embodiment, a weather measuring device 20 and a threshold value registration unit 22 are provided in the detection device body 2. Here, the weather measuring device 20 is to measure weather conditions such as temperature, humidity, barometric pressure, precipitation and snowfall, wind speed, wind direction, and the amount of solar radiation, similarly to the weather measuring device described in the second embodiment. The threshold value registration unit 22 includes, for example, a table memory, in which threshold values corresponding to respective weather conditions are registered in association with each of the detection zones X1, X2, . . . Xn that are set in advance for the trespass detection sensor 1, as shown in FIG. 11.

Moreover, the threshold value setting unit 14 is to search the threshold value registration unit 22 for a threshold value corresponding to the weather condition measured by the weather measuring device 20, and set the threshold value as a current threshold value.

The other parts of the configuration are similar to those of the first embodiment shown in FIG. 4.

Thus, in the third embodiment, when a weather condition is measured by the weather measuring device 20, the threshold value setting unit 14 refers to the threshold value registration unit 22 and selects a threshold value corresponding to the weather condition at the time for each of the detection zones X1, X2, . . . Xn. Then, these threshold values are provided to the trespass detection determining unit 15.

For example, in FIG. 11, in the case where the weather condition measured by the weather measuring device 20 is "2" (for example, rain), threshold values Δsh12, Δsh22, . . . . Δshn2 corresponding to this weather condition "2" are selected for the respective detection zones X1, X2, . . . Xn and these values are provided to the trespass detection determining unit 15.

Thus, also in the third embodiment, when the electronic wave environment is changed by a change in weather conditions, accordingly, a proper threshold value is set constantly and automatically by the threshold value setting unit 14. Therefore, dynamic adjustment in trespass detection can be made.

Fourth Embodiment

Figure 12:
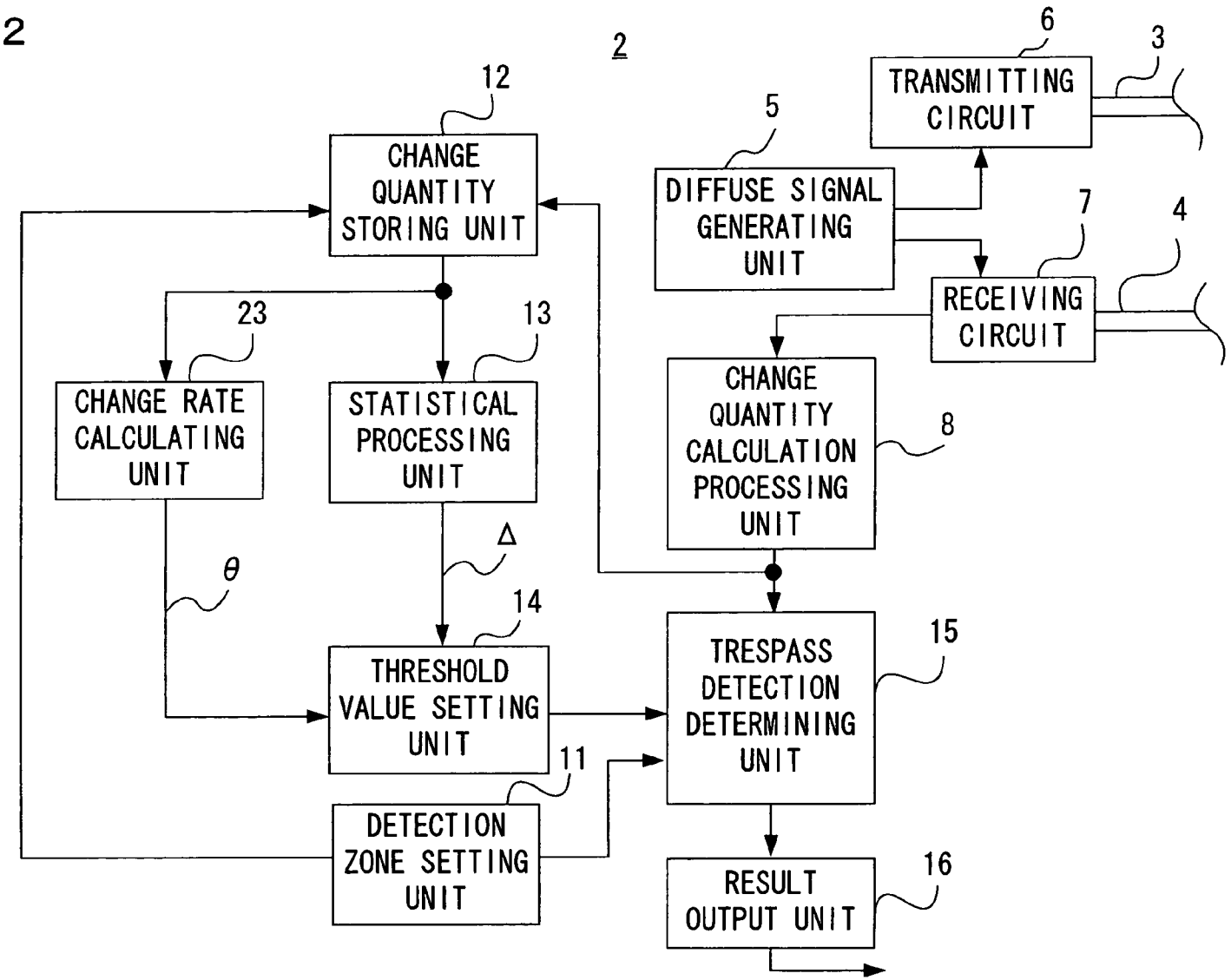
FIG. 12 is a block diagram showing the configuration of a detection device body in a trespass detection system according to the fourth embodiment of the invention.

FIG. 12 is a block diagram showing the configuration of a detection device body 2 in a trespass detection system according to the fourth embodiment. The components corresponding to the configuration of the first embodiment shown in FIG. 4 are denoted by the same numerals.

In the trespass detection system according to the fourth embodiment, the detection device body 2 is provided with a change rate calculating unit 23 which calculates an average change rate at each sampling interval Tb (for example, one-minute interval) with respect to the quantity of change in field intensity stored in the change quantity storing unit 12 over a predetermined period Ta for each of the detection zones X1, X2, . . . Xn.

In the case where the value of the average change rate calculated by the change rate calculating unit 23 exceeds a preset reference value, the threshold value setting unit 14 preferentially sets a new threshold value corresponding to the average change rate calculated by the change rate calculating unit 23, rather than a threshold value based on the value that is statistically processed by the statistical processing unit 13.

The other parts of the configuration are similar to those of the first embodiment shown in FIG. 4.

Figure 13:
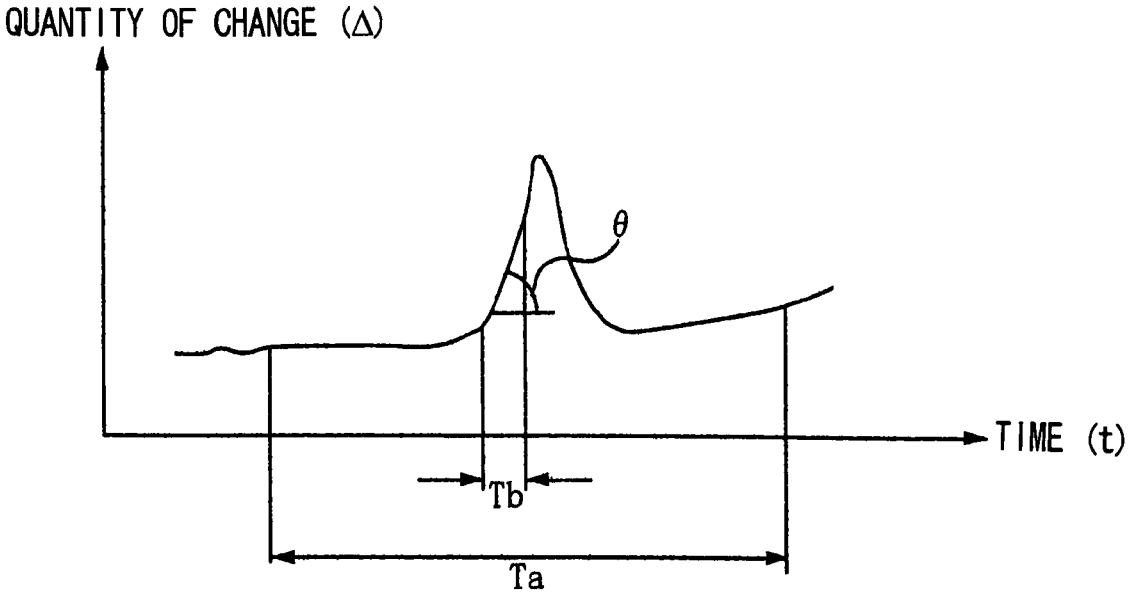
FIG. 13 is an explanatory view in the case of calculating the rate of change with respect to the quantity of change by a change rate calculating unit of the detection device body in the system.

Thus, in the fourth embodiment, in the case where the quantity of change in field intensity in a certain detection zone Xi over the predetermined period Ta stored in the change quantity storing unit 12 is, for example, as shown in FIG. 13, the change rate calculating unit 23 calculates the average change rate (slope of the curve) θ at each sampling interval Tb (for example, one-minute interval) of the quantity of change in field intensity in this detection zone Xi over the predetermined period Ta. Then, in the case where the value of the average change rate θ exceeds a preset reference value θsh, the threshold value setting unit 14 sets Δshi+f(θ), where Δshi represents the previous threshold value for the detection zone Xi and f(θ) represents a threshold value correcting function.

In this manner, in the case where a singularity point is shown such as sudden increase in the quantity of change in field intensity, a newly set threshold value is increased accordingly. Therefore, the influence of the singularity point in the quantity of change in field intensity can be temporarily eliminated. There is less risk of a determination error or misinformation that there is trespassing, by the trespass detection determining unit 15.

Fifth Embodiment

Figure 14:
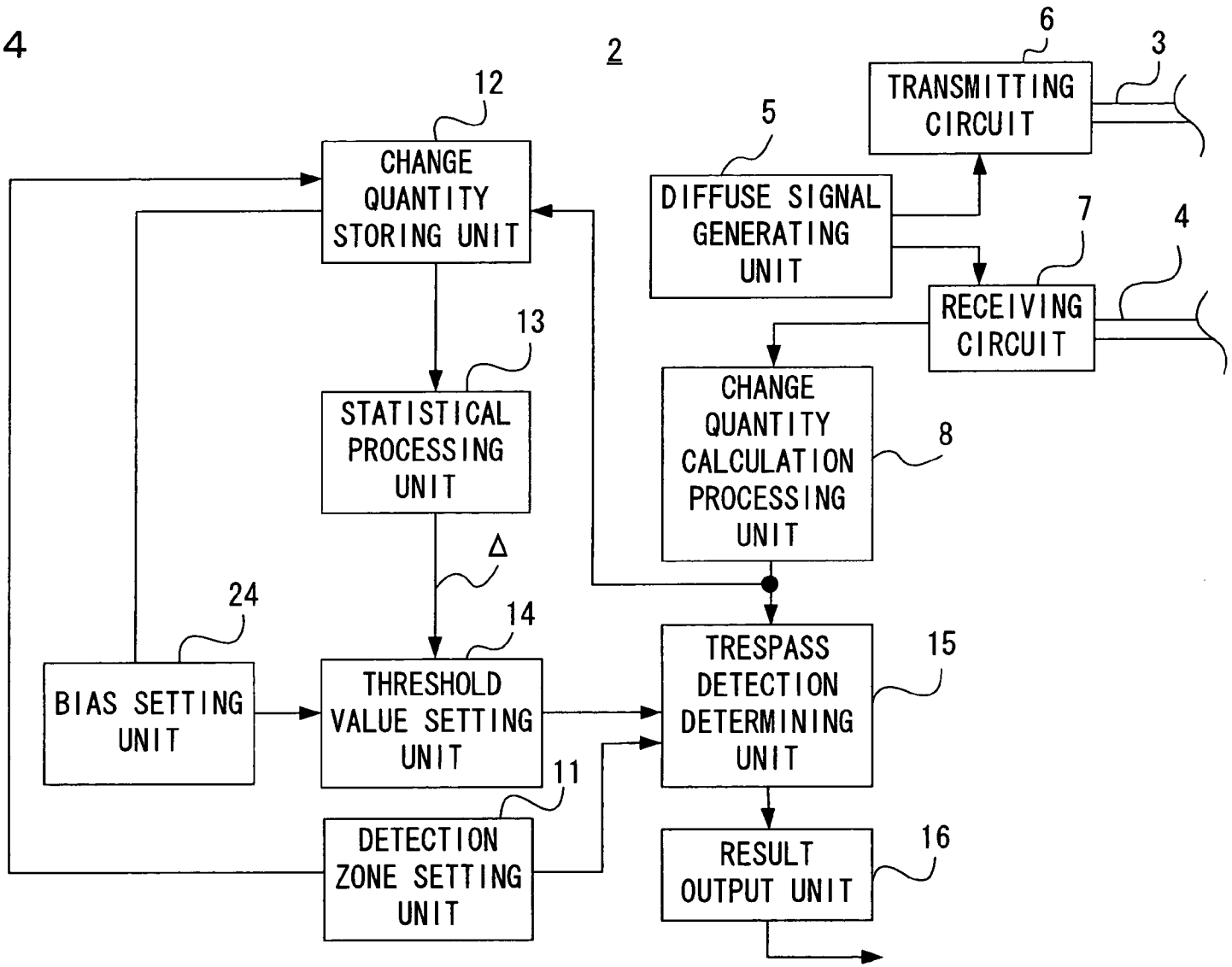
FIG. 14 is a block diagram showing the configuration of a detection device body of a trespass detection system according to the fifth embodiment of the invention.

FIG. 14 is a block diagram showing the configuration of a detection device body 2 in a trespass detection system according to the fifth embodiment. The components corresponding to the configuration of the first embodiment shown in FIG. 4 are denoted by the same numerals.

In the trespass detection system according to the fifth embodiment, the detection device body 2 is provided with a bias setting unit 24. The bias setting unit 24 is to evenly increase or decrease all the threshold values set for the respective detection zones by a predetermined amount, in the case where the quantities of change in plural detection zones that are specified in advance, of the quantities of changes for the respective detection zones X1, X2, . . . Xn stored in the change quantity storing unit 12, exceed the threshold values.

The other parts of the configuration are similar to those of the first embodiment shown in FIG. 4.

Thus, in the fifth embodiment, for example, in the case where two detection zones X2 and Xn are specified for monitoring and the quantities of change in field intensity in the detection zones X2 and Xn (the moving average of the quantity of change shown in FIG. 8) exceed the threshold values Δsh2 and Δshn set for these detection zones, the bias setting unit 24 evenly increases or decreases all the threshold values set for the detection zones X1, X2, X3, . . . Xn by a predetermined amount ρ. That is, if the existing threshold value set for a certain detection zone Xi is Δshi, Δshi+ρ is set as a new threshold value for the detection zone Xi.

In this manner, in the fifth embodiment, since the bias setting unit 24 is provided, when the electronic wave environment is changed in a broad range in the trespass surveillance area A due to a change in weather conditions or the like, the threshold values set for all the detection zones X1, X2, . . . Xn are evenly increased or decreased accordingly. Therefore, adjustment to a change in the environment can be quickly made, and occurrence of a determination error or misinformation by trespass detection determining unit 15 can be reduced.

Sixth Embodiment

Figure 15:
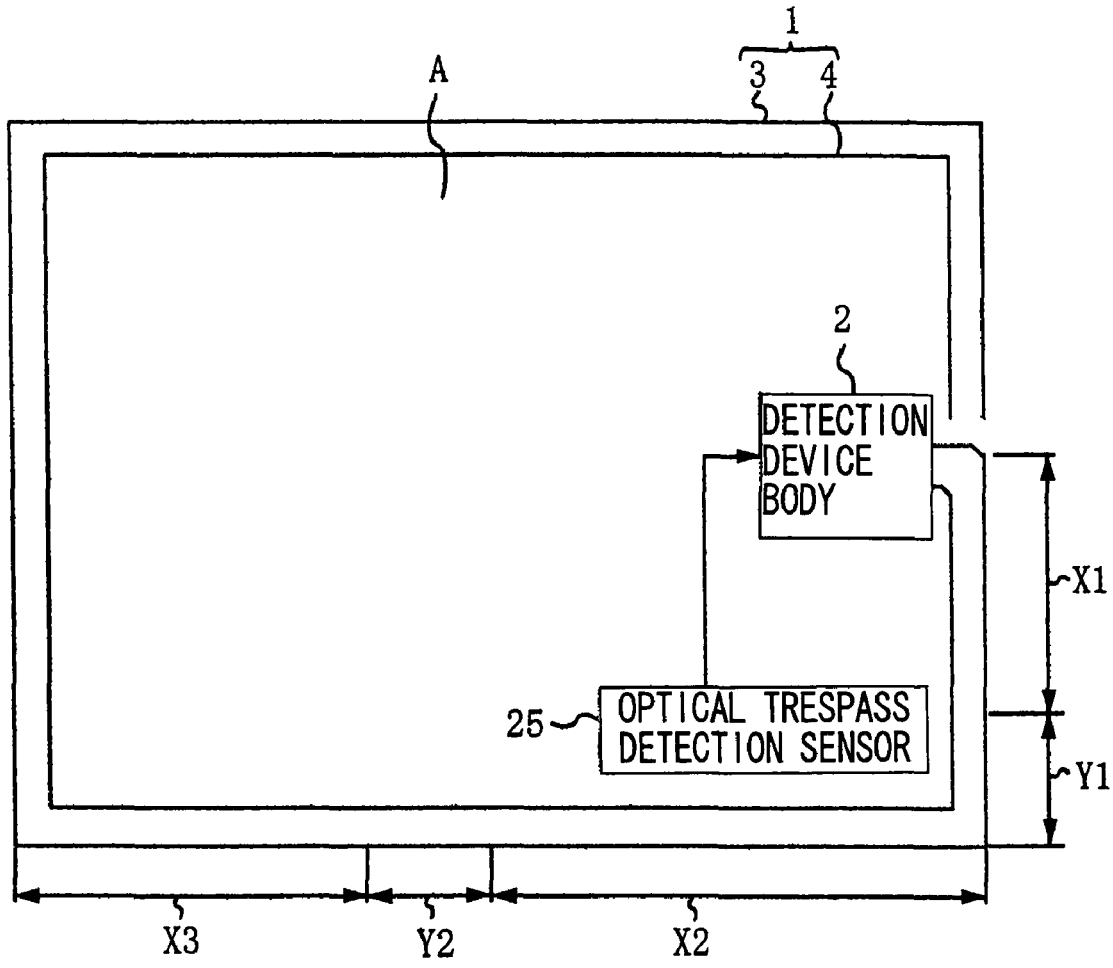
FIG. 15 is a configuration view of a trespass detection system according to the sixth embodiment of the invention.

In a trespass detection system according to the sixth embodiment, an optical trespass detection sensor 25 which detects trespassing onto the trespass surveillance area A is provided, as shown in FIG. 15, in addition to the configuration of the first embodiment (that is, the electronic-wave trespass detection sensor 1 and the detection device body 2). As the optical trespass detection sensor 25 in this case, for example, a surveillance camera, infrared sensor or the like is used.

In the case where trespassing by an object that is not a detection target is detected by the optical trespass detection sensor 25, the detection device body 2 stores the quantity of change in field intensity detected by the electronic-wave trespass detection sensor 1 at that time, into the change quantity storing unit 12. After that, in the case where the same change pattern is detected again by the electronic-wave trespass detection sensor 1, processing to remove the same quantity of change as stored in the change quantity storing unit 12 is carried out.

In this manner, in the case where a human body is a detection target and a small animal or the like is not a detection target, an object that has different size and movement from a human body and hence is not a detection target can be learned in advance. When such an object that is not a detection target has trespassed, occurrence of a determination error or misinformation that there is trespassing, by the trespass detection determining unit 15, can be reduced.

Various modifications and alterations of this invention will be apparent to those skilled in the art without departing from the scope and spirit of this invention, and it should be understood that this is not limited to the illustrative embodiments set forth herein.

What is claimed is:

1. A trespass detection system comprising:

an electronic-wave trespass detection sensor which is provided near a boundary of a trespass surveillance area and which has a transmitting-side leakage transmission line and a receiving-side leakage transmission line arranged parallel to each other at a predetermined space from each other; and a detection device body including a change quantity storing unit which stores a quantity of change in electric field intensity when an electronic wave leaked from the transmitting-side leakage transmission line is received on the receiving-side leakage transmission line over a predetermined period for each detection zone from a plurality of preset detection zones along a direction of extension of the electronic-wave trespass detection sensor;

a change rate calculating unit calculating a rate of change per unit time of the quantity of change for each detection zone from the plurality stored in the change quantity storing unit;

a statistical processing unit which statistically processes each quantity of change stored in the change quantity storing unit, a threshold value setting unit which corrects a preset threshold value for each detection zone on the basis of the result of processing by the statistical processing unit and sets a new threshold value, and a trespass detection determining unit which determines that there is trespassing by an object into a trespass surveillance area in the case where the quantity of change in electric field intensity is larger than a corrected threshold value set by the threshold value setting unit.

2. A trespass detection system comprising:

an electronic-wave trespass detection sensor which is provided near a boundary of a trespass surveillance area and which has a transmitting-side leakage transmission line and a receiving-side leakage transmission line arranged parallel to each other at a predetermined space from each other; and a detection device body including a weather measuring device which measures weather conditions from the group comprising temperature, humidity, barometric pressure, precipitation and wind speed, a threshold value registration unit in which a threshold value corresponding to each weather condition is registered in advance in association with each preset detection zone along the direction of extension of the electronic-wave trespass detection sensor, a threshold value setting unit which searches the threshold value registration unit for a threshold value corresponding to a weather condition measured by the weather measuring device and sets the threshold value as a current threshold value, and a trespass detection determining unit which determines that there is trespassing by an object into a trespass surveillance area in the case where a quantity of change in electric field intensity when an electronic wave leaked from the transmitting-side leakage transmission line is received on the receiving-side leakage transmission line is larger than the threshold value set by the threshold value setting unit.

3. The trespass detection system according to claim 1, wherein when the value of the change rate calculated by the change rate calculating unit exceeds a preset reference value, the threshold value setting unit sets a new threshold value in accordance with the change rate calculated by the change rate calculating unit, rather than a threshold value based on the value that is statistically processed by the statistical processing unit.

* * * * *